US006425997B1

(12) United States Patent
Johnson

(10) Patent No.: US 6,425,997 B1
(45) Date of Patent: Jul. 30, 2002

(54) PROCESS FOR REMOVAL OF CHLORIDE IONS FROM STEEL SURFACES

(76) Inventor: William C. Johnson, 1522 State Ave., Coraopolis, PA (US) 15108

( * ) Notice: Subject to any disclaimer, the term of this patent is extended or adjusted under 35 U.S.C. 154(b) by 0 days.

(21) Appl. No.: 09/597,846

(22) Filed: Jun. 20, 2000

(51) Int. Cl.[7] ..... C23F 13/00

(52) U.S. Cl. ..... 205/705; 205/710; 205/711; 205/717; 205/724; 205/731; 205/734; 205/735

(58) Field of Search ..... 205/705, 710, 205/711, 717, 724, 731, 734, 735

(56) References Cited

U.S. PATENT DOCUMENTS

| | | | |
|---|---|---|---|
| 3,491,012 A | 1/1970 | Winslow | 204/195 |
| 3,497,442 A | 2/1970 | Vincent | 204/195 |

(List continued on next page.)

OTHER PUBLICATIONS

Johnson, W.C., "Detrimental Materials at the Steel/Paint Interface," New Concepts for Coating Protection of Steel Structures, ASTM STP 841, Berger, D.M. and Wint, R.F., Eds., ASTM, Philadelphia, PA 1964, pp. 28–43 (See pp. 31–32).

Weldon, Dwight G.,Buehan, Alan, and Schleiden, Marianne, J. Protective Coatings and Linings, Jun. 1987, pp. 46–58 (see pp. 56–57).

Johnson, W.C., "Cost Effective Extraction of Chlorides from Bridge Steel," J. Protective Coatings and Linings, Jan. 1997.

(List continued on next page.)

*Primary Examiner*—Arun S. Phasge
(74) *Attorney, Agent, or Firm*—Harry D. Anspon

(57) ABSTRACT

A process for removing chloride ions from steel surfaces and measuring the amount present on the steel surface being tested employs a high frequency waveform alternating current treatment as a pre-measurement step to liberate the chloride ions into deionized water on the steel surface being tested. The conductivity of the water containing the chloride ions is measured in a conductivity cell mounted on the same steel surface being tested. Recovery of chloride ions originally present on the steel test surface (cathode) is 85–95% complete when a sine wave high frequency alternating current is used between the steel test surface (cathode) sealed below an insulating plastic box containing the deionized water and which plastic box contains a steel plate (anode) mounted within and immediately below the inside top of the plastic box conductivity cell. The conductivity of the water in the cell is measured by a conductivity meter after disconnecting the high frequency waveform alternating current. The conductivity of the water in the cell after pretreatment is converted to $\mu$g of chloride ions per sq. cm. A field instrument to measure chloride ions per sq. cm. can be built utilizing such a cell with a pretreatment step and a conductivity measurement step capability in one instrument. This process can be operated with water flowing from a metal nozzle (anode) onto a steel (cathode) surface to remove chloride ions on the steel (cathode) surface prior to painting.

21 Claims, 8 Drawing Sheets

U.S. PATENT DOCUMENTS

| | | | | |
|---|---|---|---|---|
| 3,710,237 | A | 1/1973 | Watson et al. | 324/446 |
| 3,808,523 | A | 4/1974 | Jobe | 324/446 |
| 3,829,761 | A | 8/1974 | Shimizu et al. | 324/30 B |
| 3,830,480 | A | 8/1974 | Grant | 266/34 LM |
| 3,849,723 | A | 11/1974 | Allen | 324/30 R |
| 3,850,736 | A | 11/1974 | Seyl | 204/195 C |
| 3,878,064 | A | 4/1975 | Weisstuch et al. | 204/1 T |
| 3,953,790 | A | 4/1976 | Ebling et al. | 324/446 |
| 4,019,133 | A | 4/1977 | Manley et al. | 324/65 CR |
| 4,032,296 | A | 6/1977 | Hall | 422/89 |
| 4,101,828 | A | 7/1978 | Dehler | 324/65 R |
| 4,181,882 | A | 1/1980 | Isaacs et al. | 324/71 R |
| 4,226,693 | A | 10/1980 | Maes | 204/195 C |
| 4,238,298 | A | 12/1980 | Tsuru et al. | 204/1 T |
| 4,331,923 | A | 5/1982 | Akers, Jr. | 324/449 |
| 4,362,994 | A | 12/1982 | Goldsmith et al. | 324/449 |
| 4,383,221 | A | 5/1983 | Morey et al. | 324/439 |
| 4,395,318 | A | 7/1983 | Tait et al. | 202/404 |
| 4,427,945 | A | 1/1984 | Sperry, III | 324/446 |
| 4,454,006 | A | 6/1984 | Hausler et al. | 205/776 |
| 4,563,427 | A | 1/1986 | Weiss et al. | 436/6 |
| 4,800,165 | A | 1/1989 | Oka et al. | 436/6 |
| 4,806,849 | A | 2/1989 | Kihira et al. | 324/65 CR |
| 4,833,413 | A | 5/1989 | Head | 324/449 |
| 4,962,360 | A | 10/1990 | Homma et al. | 324/700 |
| 5,139,627 | A | 8/1992 | Eden et al. | 205/775.5 |
| 5,188,715 | A | 2/1993 | Chen et al. | 205/776 |
| 5,194,814 | A | 3/1993 | D'Couto | 324/446 |
| 5,221,893 | A | 6/1993 | Kondou et al. | 324/71.2 |
| 5,266,899 | A | 11/1993 | Bull et al. | 324/439 |
| 5,286,257 | A | 2/1994 | Smart et al. | 204/153.11 |
| 5,306,414 | A | 4/1994 | Glass et al. | 204/404 |
| 5,310,470 | A | 5/1994 | Agarwala et al. | 204/404 |
| 5,316,633 | A | 5/1994 | Sakai et al. | 204/153.11 |
| 5,437,773 | A | 8/1995 | Glass et al. | 204/153.11 |
| 5,483,166 | A | 1/1996 | Olsen | 324/450 |
| 5,543,717 | A | 8/1996 | Kordas | 324/444 |
| 5,583,426 | A | 12/1996 | Tiefnig | 324/700 |
| 5,674,375 | A | 10/1997 | Thompson | 204/734 |
| 6,027,633 | A * | 2/2000 | Whitmore | 205/734 |

OTHER PUBLICATIONS

Brochure on Surface Analysis with Bresle Sampler by Expertus Kemiteknik AB, 4 pp. description and 7 pp. on chemicals used, U.S. 07/494,496 design pending. (No date).

Boocock, Simon K., SSPC Research on Performance Testing of Abrasives and Salt Retrieval Techniques, Center for Protection Coatings—Carnegie Mellon Research Institute, Sep. 1993.

Boocock, Simon K., J. Protective Coatings and Linings, Mar. 1994, p. 33 Table 7 lists correction factors for different retrieval methods including Bresle blister patch cell where value measured should be multiplied by 1.8 to 2. (This research news was based on data of Publ. Ref. 6).

Methods for sampling and analyzing soluble salts on steel surfaces: A comparative study, Flores, S., Simancas, J. and Morcillo, M., J. Protective Coatings by Linings, Mar. 1994, p. 29 [Note: The Flores study was conducted with non–rusted steel as compared to Boocock's study with rusted steel. The Bresle Sampler used by Flores, et al. provided too high chloride results on non–rusted steel whereas Boocock (as well as Tator and Johnson—private communication) found only 50–60% of the chloride added on rusted steel using the Bresle Sampler.]

KTA "The Coating Consultant," Jan. 1999, New Instrument Offerings on p. 3.

Brochure on "Elcometer Model 134" "Chlor*Test" printed by Elcometer, Inc. Chlor*Test is a registered trademark of and manufactured by Chlor*Rid International, Inc. (No date).

Houghton–Mifflin, New American Heritage Dictionary of the English Language, New College Edition, p. 758, published 1979. (No month).

A conductivity meter using sinewaves is mentioned in U.S. 5,543,717 Kordas 324/444. Col. 1,1. 13–57 uses rectangular AC waves to measure conductivity and at a col. 1, 1. 58–63 Kordas mentions use of sine waves to also measure conductivity. (No date).

Orion—1999 Laboratory Products and Electrochimstry Handbook, pp. 90–91 on Conductivity Theory. (No month).

Physical Chemistry, Fifth Edition, P. W. Atkins, W. H. Freeman and Co., New York, 1994, pp. 834 and 835. (No month).

Cole–Parmer, Vernon Hills, IL 60061–1844, 1999–2000 Catalog, p. 144, Conductivity—Calibration Solutions Data. (No month).

SSPC–TU4 had tested the Bresle Sampler and noted that it found ≈50% of the chloride added to a steel surface which was rusted before testing. This technical study group also employed a conductivity cell having a design close to that of the J–Cell. However, this group did not use sine wave AC current with their cell to release chloride ions for conductivity measurement. (No date).

* cited by examiner

BRESLE SAMPLER
(PRIOR ART)

PROCESS FOR REMOVAL OF CHLORIDE IONS FROM STEEL SURFACES

BACKGROUND AND FIELD OF INVENTION

This application relates to corroded and pitted steel surfaces and the removal and measurement of chloride ions present thereon, which ions are known to promote corrosion of steel surfaces.

RELATED ART

Chloride ions an known to accelerate the corrosion on of steel surface (Publ. Ref. 1). Before a steel surface is painted, it is desirable to know whether chloride ions are present and their contamination level since painting over chloride ions will allow corrosion to proceed under the paint coat (Publ. Ref. 2). As little as 10 $\mu$g. chloride ion per square cm. of steel surface will accelerate the corrosion of steel surfaces (Publ. Ref. 3).

Chloride ion contamination of steel surfaces is a widespread problem caused by circumstances as diverse as the ocean shipping of steel and the use of salt on road surfaces such as bridges in winter.

Drastic steps, such as sandblasting of steel surfaces, often are used to remove corrosion products and chlorides prior to painting. However, one sandblasting step often is not enough to remove all the chloride ions, and rapid corrosion after sandblasting can occur overnight under humid conditions (Publ. Ref. 4).

In addition to the prevalence of chloride contamination of steel surfaces and the difficulty of removing chloride ion contamination, it is also difficult to obtain a valid measurement of the concentration level of chloride ions present on a steel surface.

Bresle Sampler

The Swedish Fire Research Laboratory (Brandforsk) developed a means of measuring chloride contamination with a Bresle Sampler (Publ. Ref 5). The Sampler is configured to be adhered to a surface with a cavity of known dimension and volume. Distilled or deionized water is injected into the cavity by syringe needle through a rubbery film. Removal of the water after one minute contact is also accomplished with a syringe needle. The water removed is analyzed by chemical reagents for its chloride content using reagents included in the Bresle Kit. Chloride contamination after fires occurs by formation of hydrogen chloride through burning of polyvinylchloride plastics and other chlorine-containing plastics.

While the Bresle Sampler is useful for removing readily extracted chlorides from steel surfaces Boocock has shown that not all chlorides arm removed from corroded and pitted steel surfaces by water washing and includes data obtained with a Bresle Sampler (Publ. Refs 6 and 7).

Flores (Publ. Ref. 8) also studied the performance of the Bresle Sampler.

While the reason for the difficulty of completely extracting chloride ions by water washes is not known for a certainty, it is believed to be caused by a phenomenon described as "Electrolytic Confinement," which will be described later.

"Elcometer 134"

In January 1999, a new test method for chlorides became known to applicant through commercial literature issued by KTA Tator, Inc. as new instrument offerings (Publ. Ref. 9).

Literature printed by Elcometer, Inc., 1893 Rochester Industrial Drive, Rochester Hills, Mich. 48309-3342 (Publ. Ref. 10) describes the testing process a follows in the brochures on "Elcometer 134" and the "CHLOR*TEST."

1. Empty the entire contents of the CHLOR*EXTRACT™ container into the CHLOR*SLEEVE™. Peel off the protective backing, pinch the sleeve to expel some of the air and adhere the sleeve to the surface to be tested.
2. Massage the extract against the surface; then peel the sleeve off the surface and place it in the perforated hole in the box lid.
3. Snap the sealed ends off the glass tube, insert it into the sleeve and down into the extract. In about two minutes read the color change to identify the chloride level in both parts per million and micro grams per centimeter squared; the ratio is 1:1.

Applicant does not know of any publication which has measured the efficiency of extraction of chlorides from standard rusted panels using the "Elcometer 134" test method.

It is clear that "Elcometer 134" is not an electrochemical test meter, but is a chemical method using an extraction solution and a Kitagawa absorbent tube for chloride measurement.

BACKGROUND OF THE INVENTION

I am aware of the following Prior Art:

| U.S. Pat. No. | INVENTOR | ISSUED | CLASS |
|---|---|---|---|
| 3,491,012 | Winslow | 1/20/70 | 204/195 |
| 3,497,442 | Vincent | 2/24/70 | 204/195 |
| 3,710,237 | Watson et al. | 1/09/73 | 324/446 |
| 3,808,523 | Jobe | 4/30/74 | 324/446 |
| 3,829,761 | Shimizu et al. | 8/13/74 | 324/30B |
| 3,830,480 | Grant | 8/20/74 | 266/34LM |
| 3,849,723 | Allen | 11/19/74 | 324/30R |
| 3,850,736 | Seyl | 11/26/74 | 204/195C |
| 3,878,064 | Weisstuch et al. | 4/15/75 | 204/IT |
| 3,953,790 | Ebling et al. | 4/27/76 | 324/446 |
| 4,019,133 | Manley et al. | 4/19/77 | 324/65CR |
| 4,032,296 | Hall | 6/28/77 | 422/89 |
| 4,101,828 | Dehler | 7/18/78 | 324/65R |
| 4,181,882 | Issacs et al. | 1/01/80 | 324/71R |
| 4,226,693 | Maes | 10/07/80 | 204/195C |
| 4,238,298 | Tsuru et al. | 12/09/80 | 204/IT |
| 4,331,923 | Akers, Jr. | 5/25/82 | 324/449 |
| 4,362,994 | Goldsmith et al. | 12/07/82 | 324/449 |
| 4,383,221 | Morey et al. | 5/10/83 | 324/439 |
| 4,395,318 | Tait et al. | 7/26/83 | 202/404 |
| 4,427,945 | Sperry, III | 6/12/84 | 324/446 |
| 4,454,006 | Hausler et al. | 6/12/84 | 205/776 |
| 4,563,427 | Weiss et al. | 1/07/86 | 436/6 |
| 4,800,165 | Oka et al. | 1/24/89 | 436/6 |
| 4,806,849 | Kihira et al. | 2/21/89 | 324/65CR |
| 4,833,413 | Head | 5/23/89 | 324/449 |
| 4,962,360 | Homma et al. | 10/09/90 | 324/700 |
| 5,139,627 | Eden et al. | 8/18/92 | 205/775.5 |
| 5,188,715 | Chen et al. | 2/23/93 | 205/776 |
| 5,194,814 | D'Couto | 3/16/93 | 324/446 |
| 5,221,893 | Kondou et al. | 6/22/93 | 324/71.2 |
| 5,266,899 | Bull et al. | 11/30/93 | 324/439 |
| 5,286,257 | Smart el al. | 2/15/94 | 204/153.11 |
| 5,306,414 | Glass et al. | 4/26/94 | 204/404 |
| 5,310,470 | Agarwala et al. | 5/10/94 | 204/404 |
| 5,316,633 | Sakal et al. | 5/31/94 | 204/153.11 |
| 5,437,773 | Glass el al. | 8/01/95 | 204/153.11 |
| 5,483,166 | Olsen | 1/09/96 | 324/450 |
| 5,543,717 | Kordas | 8/06/96 | 324/444 |
| 5,553,426 | Tiefnig | 12/10/96 | 324/700 |
| 5,674,375 | Thompson | 10/07/97 | 205/734 |

PRIOR ART CONDUCTIVITY CELL PATENTS

Of the Patents Listed Above, the Following Patents Describe Conductivity Cells and their Use:

U.S. Pat. No. 3,497,442
U.S. Pat. No. 3,710,237
U.S. Pat. No. 3,808,523
U.S. Pat. No. 3,829,761
U.S. Pat. No. 3,849,723
U.S. Pat. No. 3,953,790
U.S. Pat. No. 4,032,296
U.S. Pat. No. 4,331,923
U.S. Pat. No. 4,362,994
U.S. Pat. No. 4,383,221
U.S. Pat. No. 4,427,945
U.S. Pat. No. 4,833,413
U.S. Pat. No. 5,194,814
U.S. Pat. No. 5,266,899
U.S. Pat. No. 5,543,717
U.S. Pat. No. 5,483,166
U.S. Pat. No. 5,612,622

None of the above patents describes a conductivity cell for measuring chloride ions on rusted steel. U.S. Pat. No. 4,331,923 employs a low amplitude AC square wave current to measure conductivity while U.S. Pat. No. 5,543,717 uses a rectangular waveform and mentions use of sine waves for conductivity measurement. Although such waveforms are generally similar to the waveforms employed with the Johnson Cell (J-Cell) of this invention to release chloride Ions and to measure conductivity, none of the above patents employs a high frequency waveform in a pre-measurement step to free chloride ions from rusted steel.

While alternating current and/or impedance have been employed to measure corrosion in the following US patents, none of these patents mentions use of high frequency alternating current of any waveform being used to free chloride ions from corroded steel surfaces, nor is the any mention of its use to wash away chloride ion contamination from steel surfaces when employed with a flowing stream of water as described in the Embodiment of our invention.

PRIOR ART PATENTS ON CORROSION EMPLOYING ALTERNATING CURRENT

U.S. Pat. No. 4,019,133
U.S. Pat. No. 4,181,852
U.S. Pat. No. 4,238,298
U.S. Pat. No. 4,800,165
U.S. Pat. No. 4,806,849
U.S. Pat. No. 4,962,360
U.S. Pat. No. 5,221,893
U.S. Pat. No. 5,583,426

OTHER PRIOR ART PATENTS

The Remaining Patents in Prior Art are Briefly Described Below:

U.S. Pat. No. 3,491,012: Describes a means of refinishing a pitted electrode assembly while maintaining equal areas in the electrodes used.

U.S. Pat. No. 3,830,480: Sampler for molten metal to measure metal temperature and its gaseous content.

U.S. Pat. No. 3,850,736: Device for catholically polarizing two duplicated electrodes with substantially no interference with corrosion current measurement with said electrodes.

U.S. Pat. No. 3,878,064: Pitting tendency is qualitatively measured by current flowing to equal the open-circuit cathode-reference electrode potential under a restricted oxygen access condition.

U.S. Pat. No. 4,101,828: A water saturated filter paper is placed on a metal surface, and the electrical resistance of the chemical solution in the filter paper is measured to indicate when the water has extracted contaminants from the metal surface that requires washing of the metal surface to remove corrosive chemicals from the metal surface. Although a square wave current is employed, there is no indication of its use to remove trapped chloride or to measure the chloride ions present except an a screening procedure to indicate a contamination level requiring washing of the metal surface to remove corrosive contamination collected on the metal surface. The square wave is used to eliminate formation of chemical cells within the sample to be measured.

U.S. Pat. No. 4,226,693: A temperature control is an integral part of a corrosion probe.

U.S. Pat. No. 4,563,427: A corrosion test assembly is described for placement in a flowing gaseous medium for subjection to corrosive materials therein, more particularly, in scrubber systems.

U.S. Pat. No. 5,286,357: A corrosion sensor is described for detecting corrosion of a surface incorporating the sensor. The sensor is a thin flexible ion-conducting film and an overwrap of at least two thin flexible metallic electrodes whose current by electrochemical action upon corrosion is measured.

U.S. Pat. No. 5,310,470: A light-weight corrosivity senor is provided comprising a thin, non-conductive base and two electrically isolated conductive dements to the surface thereof. The sensor is connected to a current measuring means for determining current across the two conductive elements as an indicator of a corrosive environment.

U.S. Pat. No. 5,437,773: Measures deposited chloride ions on surfaces with an ion specific electrode but does not extract chloride ions from rusted steel.

U.S. Pat. No. 5,674,375: This patent detects corrosion of cathodically protected steel structures in soil and concrete in which the cathodic protection circuit is subjected to an eletrochemical impedance spectroscopic analysis with corrosion indicated by the present of a Warburg impedance. No extraction or measurement of chloride or other corrosion promoting ions is mentioned.

DETAILED DESCRIPTION OF THE DRAWINGS

Figure 1:
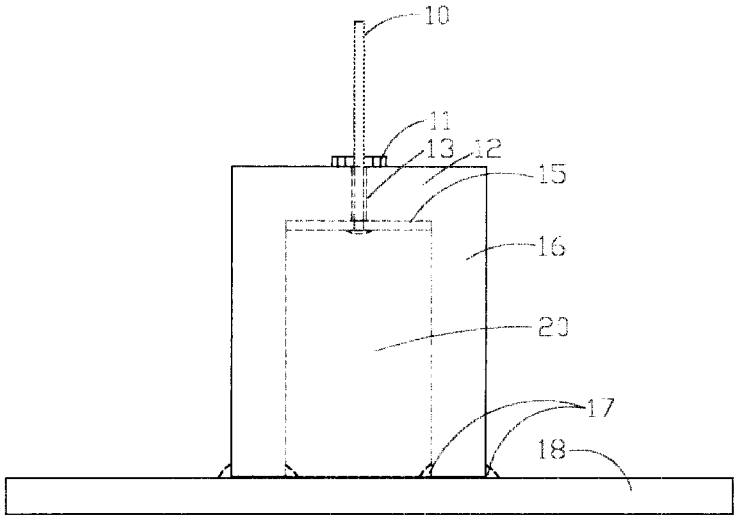
FIG. 1 is an end view of the J-Cell (conductivity cell) of this invention mounted on a steel panel cathode with high-strength pressure sensitive water-resistant plastic adhesive using a C-clamp (not shown).

FIG. 1, the end view of the J-Cell (conductivity cell), shows the rigid water-resistant inverted plastic box 16 which is mounted on steel panel 18. The inverted plank box 16 is seated to the steel panel 18 by high-strength pressure-sensitive water-resistant adhesive 17. The plastic box 16 is held on the steel panel 18 bay a C-clamp (not shown). The top 12 of the inverted plastic box 16 contains two holes, hole 13 and hole 14 (not shown), centered in the top 12 in Its short dimension.

Steel sheet 15 is held against the inside surface of top 12 by a steel bolt 10 on which a nut 11 is threaded down to the outside surface of top 12 of inverted plastic box 16. An alligator clamp (not shown), applied to the protruding steel bolt 10 attaches an electric lead wire to the steel bolt 10 and steel sheet 15, which becomes the anode during the pre-measurement treatment step (described later). Hole 14 (not shown) is a second opening through the top 12 of plastic box 16. The hole 14 (not shown) in plastic box 16 leads to a hole 19 (not shown) in steel sheet 15. A hypodermic needle (not shown) attached to a syringe (not shown) is used to place distilled or deionized water 20 inside the sealed plastic box 16 to fill the inside of plastic box 16 and provide continuous deionized liquid water 20 contact between the bottom steel panel 18 and the steel sheet 15. The bottom steel panel 18 is clamped to a cathode wire (not shown) at a bare spot filed on steel panel 18 outside of the area covered by plastic box 16.

Figure 2:
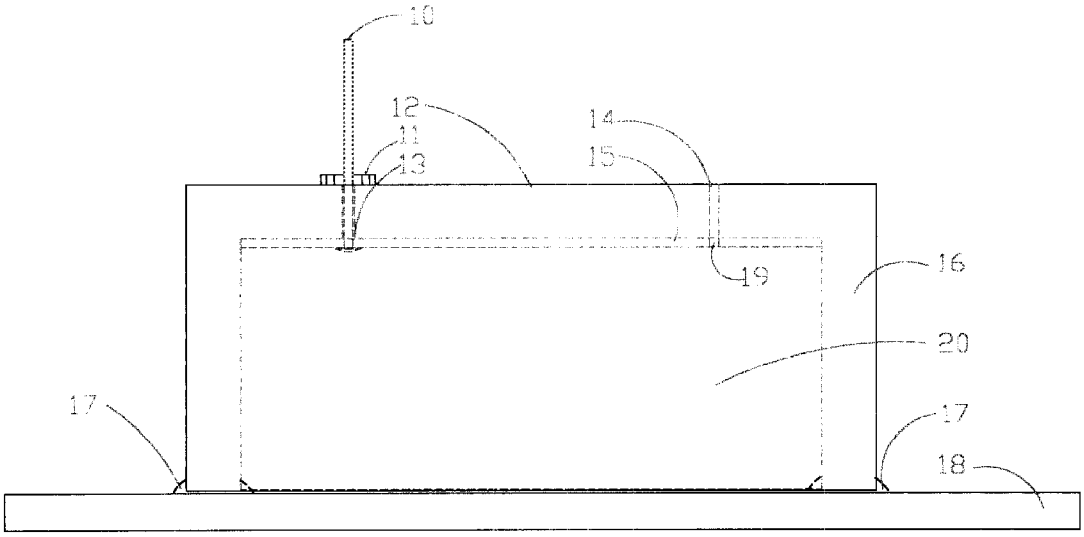
FIG. 2 is a side view of the same J-Cell of FIG. 1 mounted on the steel panel cathode with high-strength pressure-sensitive water-resistant adhesive using a C-clamp (not shown).

FIG. 2, the side view of the J-Cell shows the rigid water-resistant inverted plastic box 16 which is mounted and sealed on steel panel 18 by high-strength pressure-sensitive water-resistant adhesive 17. The plastic box 16 is initially held on the steel panel 18 by a C-clamp (not shown). The top 12 of the inverted plastic box 16 contains two holes, 13 and 14 (not shown), centered in the short dimension of top 12, and equidistant from the opposing ends of the long dimension of top 12 of plastic box 16.

A steel sheet 15 is held against the inside surface of the top 12 by a steel bolt 10 passing through a hole (not shown) in steel sheet 15 on which bolt 10 is threaded a nut 11 down to the outside surface of top 12 of inverted plastic box 16. An alligator clamp (not shown), attached to the protruding steel bolt 10, connects an electric lead wire to steel bolt 10 and steel sheet 15, which becomes the anode during the pre-measurement treatment step. The hole 14 (not shown) is a second opening through the top 12 of inverted plastic box 16. The hole 14 (not shown) in top 12 of inverted plastic box 16 leads to a hole 19 (not shown) in steel sheet 15. A hypodermic needle (not shown), attached to a syringe (not shown), is used to place deionized water 20 inside the sealed plastic box 16 to fill the inside of plastic box 16 and provide continuous deionized liquid water 20 contact between the bottom steel panel 18 and the steel sheet 15. The bottom steel panel 18 is clamped to a cathode wire (not shown) at a bare spot filed on steel panel 18 outside of the area covered by plastic box 16.

Figure 3:
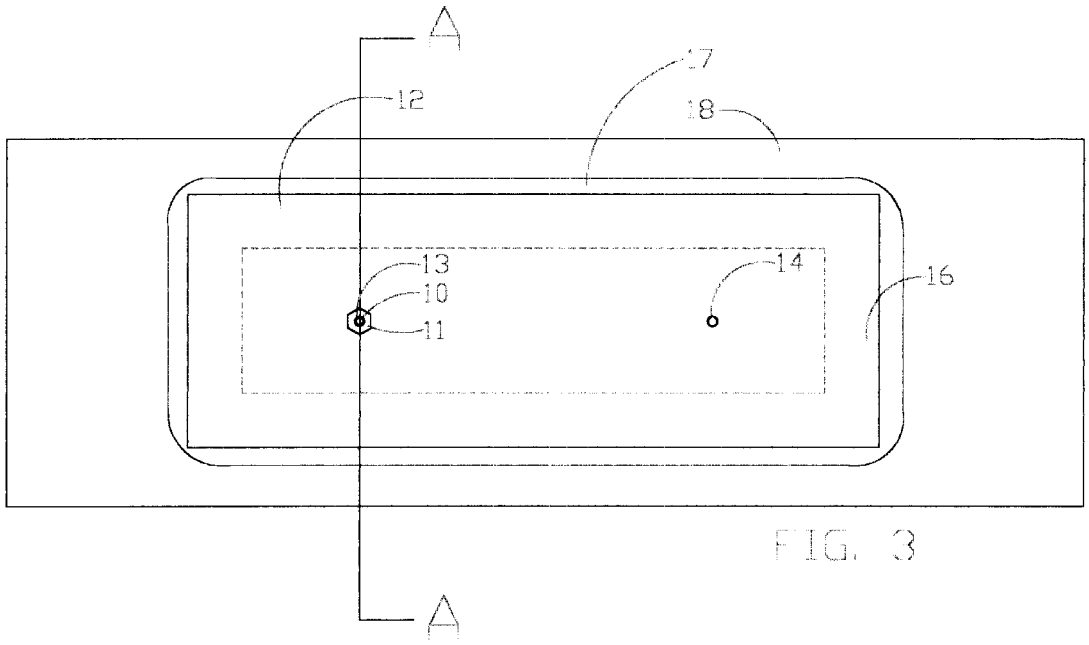
FIG. 3 is a view of the same J-Cell looking down on the top of the J-Cell mounted on the steel panel cathode with high-strength pressure-sensitive water-resistant plastic adhesive and held in place by a C-clamp (not shown).

FIG. 3 is the view of the J-Cell looking down on the top 12 of the inverted plastic box 16. A section fine A–A' is taken though steel bolt 10 and nut 11 protruding above top 12 of inverted plastic box 16.

Figure 4:
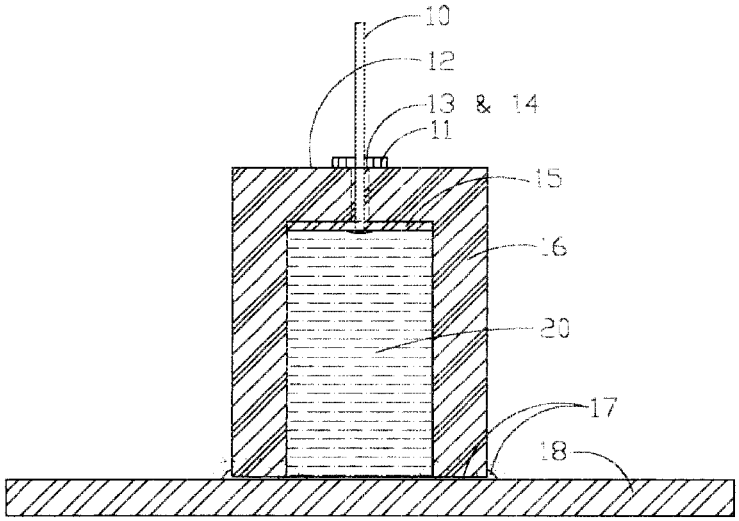
FIG. 4 is a cross section view along line A–A' shown on FIG. 3.

FIG. 4 is the cross-section of the J-Cell shown in FIG. 3 taken along the A–A' line through steel bolt 10 and nut 11 and inverted plastic box 16. The cross-section shows the top 12 of inverted plastic box 16 and the steel bolt 10 passing through hole 19 (not shown) in steel sheet 15 and held in place by steel nut 11. Steel bolt 10 passes through the top 12 of inverted plastic box 16 by way of hole 13. The deionized water 20 fills the interior of plastic box 16 between the bottom steel panel 18 being analyzed and the steel sleet 15 anode against the top 12 of inverted plastic box 16. The deionized water 20 is prevented from leaking out of inverted plastic box 16 by high-strength pressure sensitive water-resistant adhesive 17.

Figure 5:
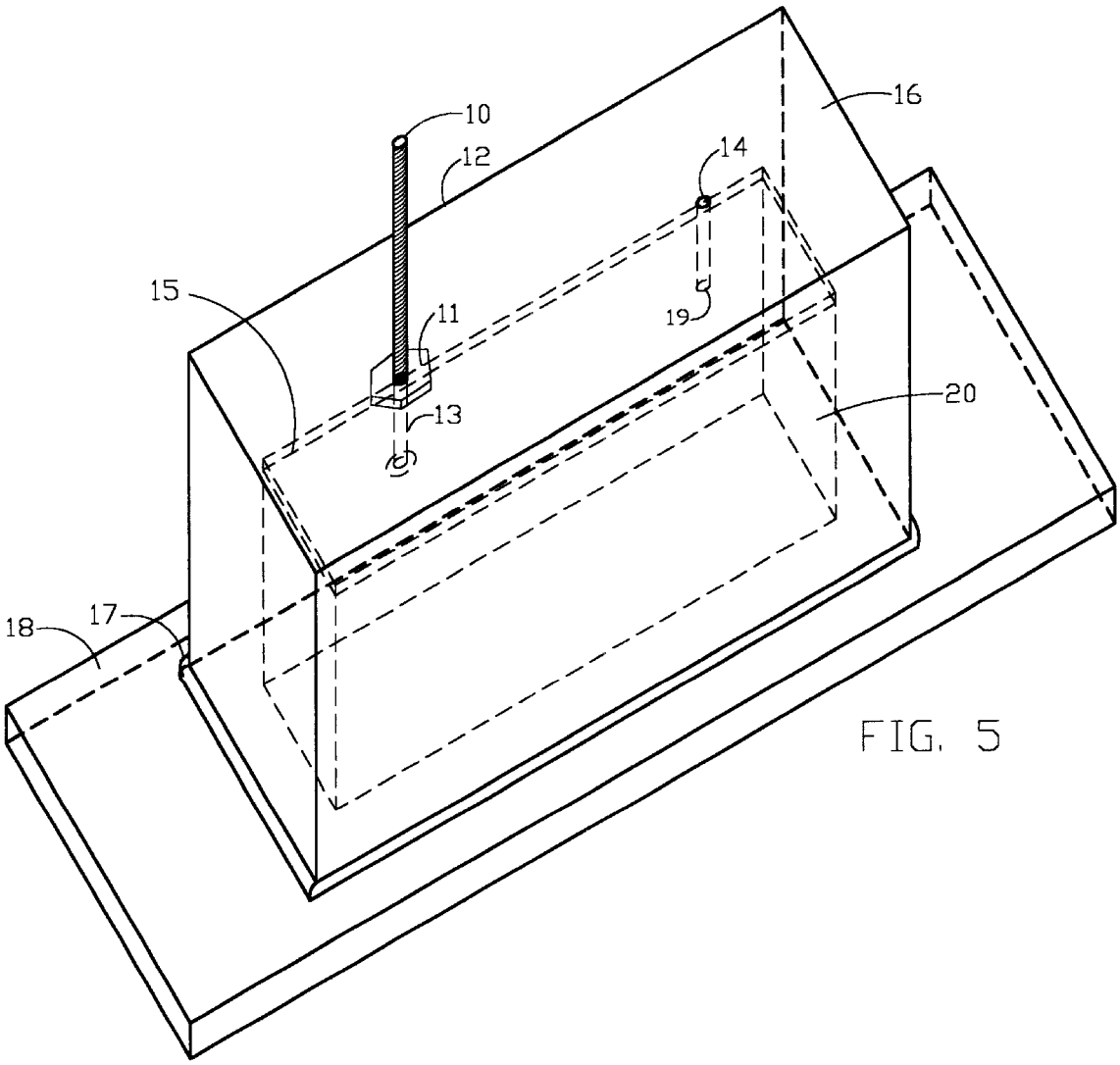
FIG. 5 is a perspective view of the J-Cell.

FIG. 5 is a perspective view of the J-Cell showing inverted plastic box 16 mounted on steel panel 18 by high-strength pressure-sensitive water-resistant adhesive 17. The inverted plastic box 16 is held on the steel panel 18 by a C-clamp (not shown). The top 12 of the inverted plastic box 16 contains two holes, 13 and 14, centered in the short dimension of top 12 and equidistant from the opposing ends of the long dimension of top 12 of plastic box 16. A steel plate 15 is held against the inside of the top 12 by a steel bolt 10 which passes through a hole (not shown) in steel sheet 15, and which fits through hole 13 to hold steel sheet 15 against the inside top of plastic box 16 by a nut 11. An alligator clamp (not shown) attaches an electric lead wire to the steel bolt 10 and steel plate 15, which becomes the anode during the pre-measurement treatment step (described later). Hole 14 is a second opening through the top 12 of plastic box 16. The hole 14 in plastic box 16 leads to a hole 19 in steel sheet 15. A hypodermic needle (not shown) attached to a syringe (not shown) is used to place distilled or deionized water 20 inside the plastic box 16 to fit it and provide continuous liquid water contact between the bottom steel panel 18 and the see sheet 15 inside the plastic box 16. Steel sheet 15 is held against the inside of the top of plastic box 16 by steel bolt 10 and nut 11. The bottom steel panel 18 is clamped to a cathode wire (not shown) at a bare spot filed on steel panel 18 outside of the area covered by plastic box 16 and adhesive 17. The plastic box 16 is initially held against steel panel 18 with a C-clamp (not shown). The hypodermic needle and syringe can be used to remove the water solution of contaminations through holes 14 and 19.

Figure 6:
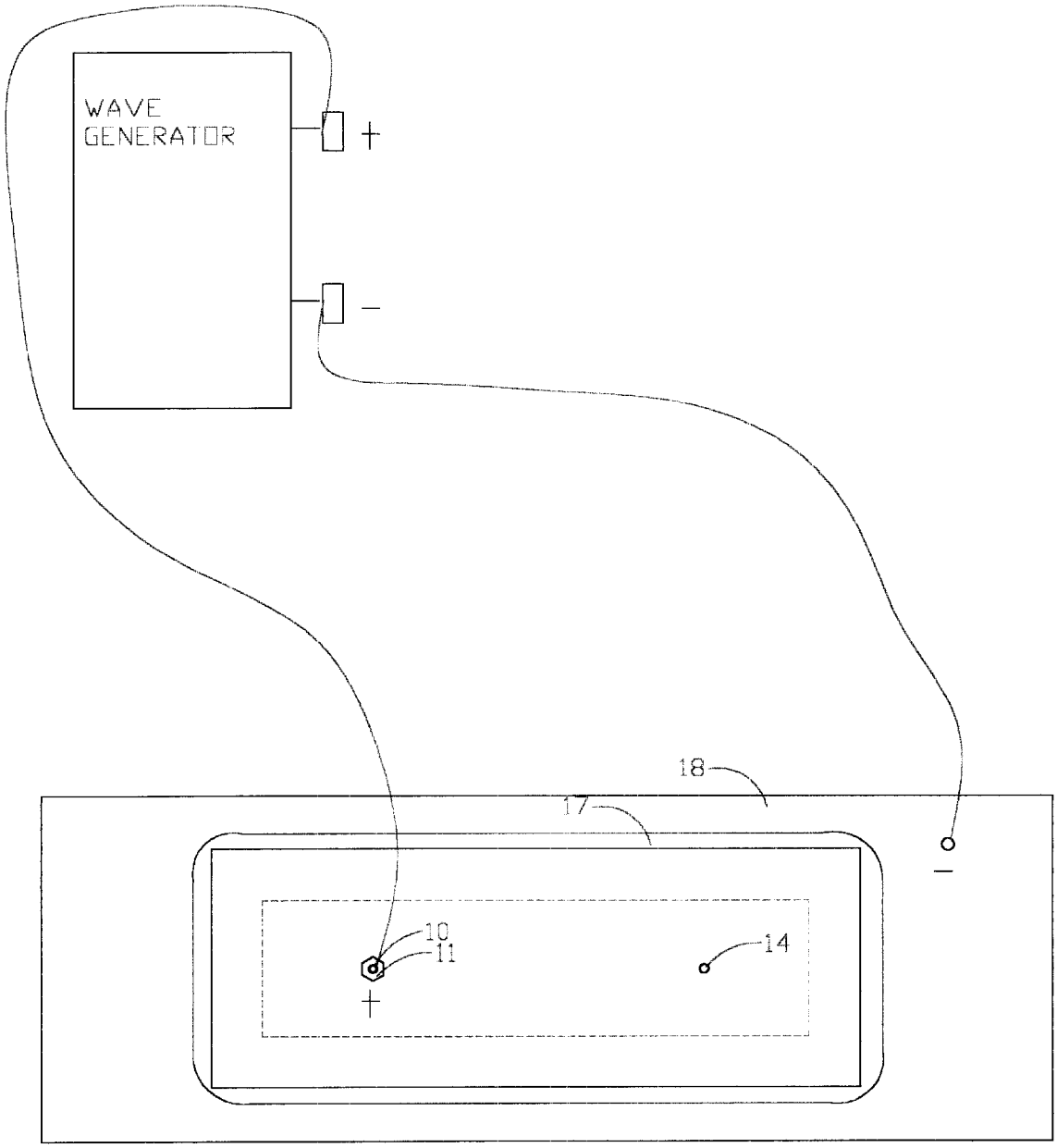
FIG. 6 shows the electrical connections for the pre-measurement treatment step of this invention.

FIG. 6 shows the electrical connections to the J-Cell for the pre-measurement treatment step of this invention.

Figure 7:
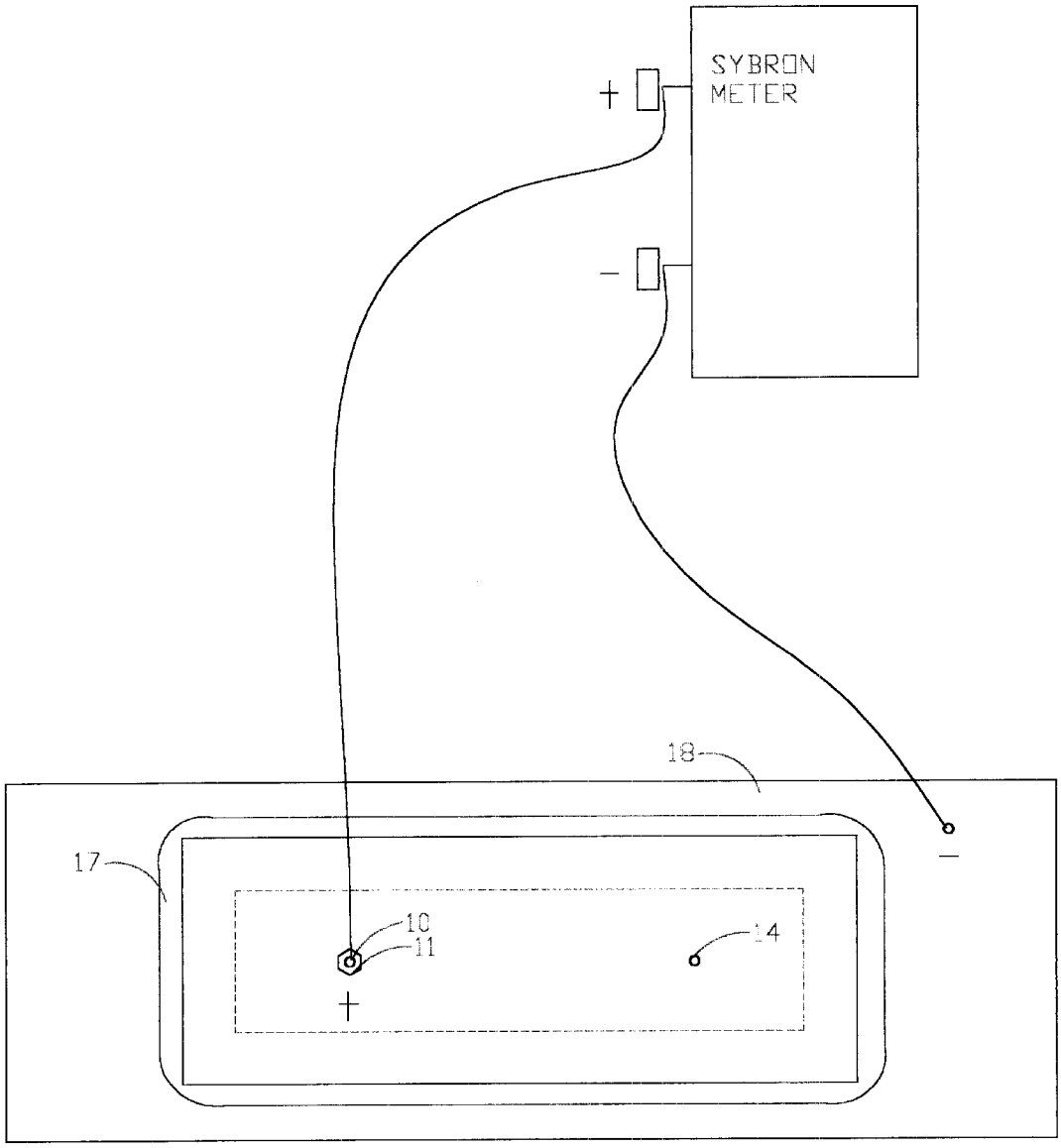
FIG. 7 shows the electrical connections for the conductivity measurement step of this invention.

FIG. 7 shows the electrical connections to the J-Cell for measurement of the conductivity of the water in the J-Cell by connection to a Sybron meter during We measurement step.

Figure 8:
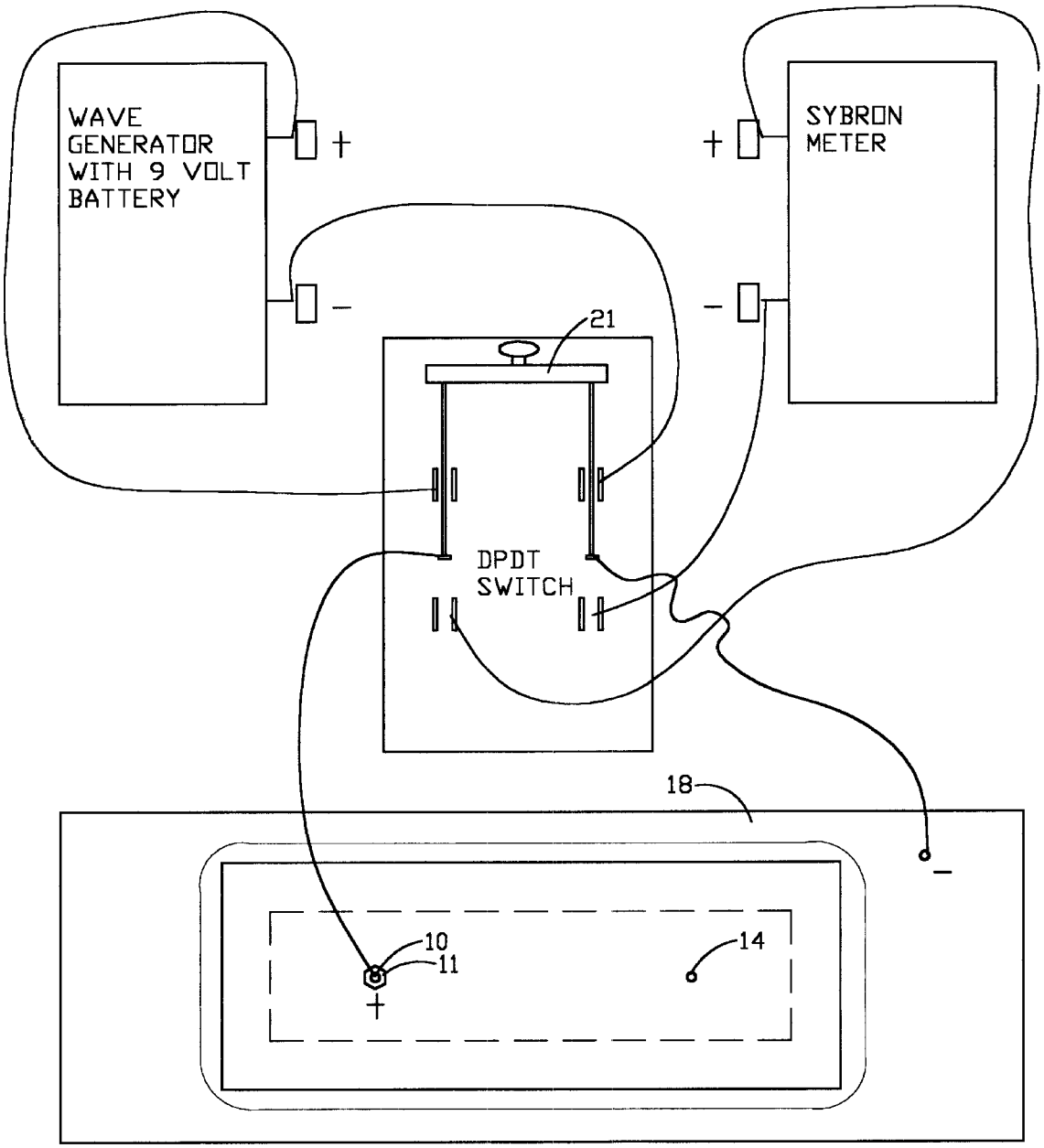
FIG. 8 shows the electrical circuitry employed to accomplish the steps of pre-measurement treatment and conductivity measurement.

FIG. 8 shows the electrical circuitry to accomplish the steps of pre-measurement treatment and measurement of the conductivity of the water in the J-Cell by a Sybron meter following the pre-measurement treatment step, with choice of circuit being controlled by DPDT switch 21.

FIG. 9 (9A and 9B) (Prior Art)

The Bresle Sampler has been employed in the Prior Art to perform analyses of surfaces including steel surfaces. The Bresle Kit with Bresle Samplers was developed for the Swedish Fire Research Laboratory (Brandforsk), This kit comprises a flexible film-backed square 24 of flexible plastic of 2 mm thickness which has a cavity area of 12.5 $cm^2$ as shown in FIG. 9A.

Figure 9A:
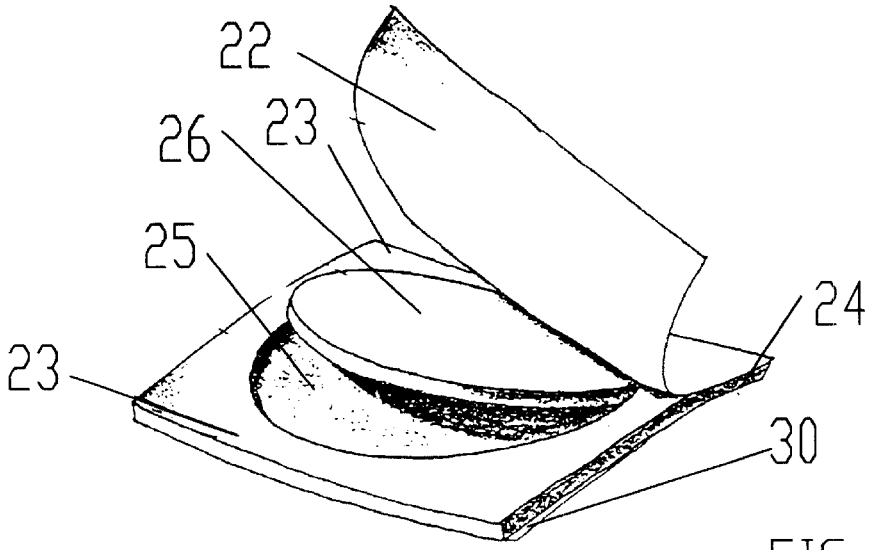
FIG. 9 (9A and 9B) (Prior Art) shows in perspectives of 9A and 9B the components of the Bresle Sampler which was developed in Sweden for field analysis of chlorides on surfaces of materials.
Figure 9B:
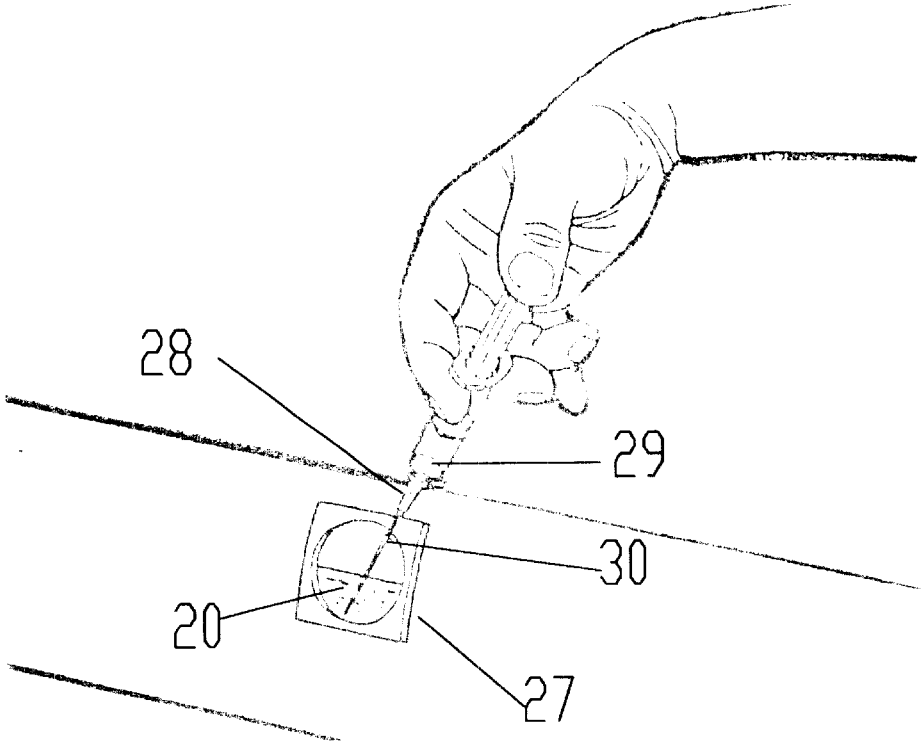

Also in FIG. 9A, the protective release paper 22 peels off from the pressure sensitive adhesive 23 coated on the 2 mm thick plastic square 24 containing an open circular cavity 12.5 $cm^2$ in area 25. The plastic filler 26 is removed after the protective release paper 22 is discarded to provide the circular cavity 25. The second perspective FIG. 9B shows the sampler adhered to a surface 27 for testing by pressing the plastic square 24 with the pressure sensitive adhesive 23 against the pipe surface 27 being tested.

The plastic square 24 with the open circular cavity 25 is adhered to test surface 27. Distilled or deionized water 20 is injected with the needle 28 of a hypodermic syringe 29 through the plastic rubber film 30 to fill the cavity 25. After one minute the added deionized water 20 is sucked out with the needle 28 of syringe 29. The water with the contamination of the test surface 27 is analyzed by the chemical reagents of the Bresle Kit.

While the Bresle Sampler is useful for removing readily extracted chlorides from surfaces, it has no provision for removing chloride ions from corroded and pitted steel surfaces which Boocock has shown to be resistant to complete chloride removal by water washing.

Figure 10:
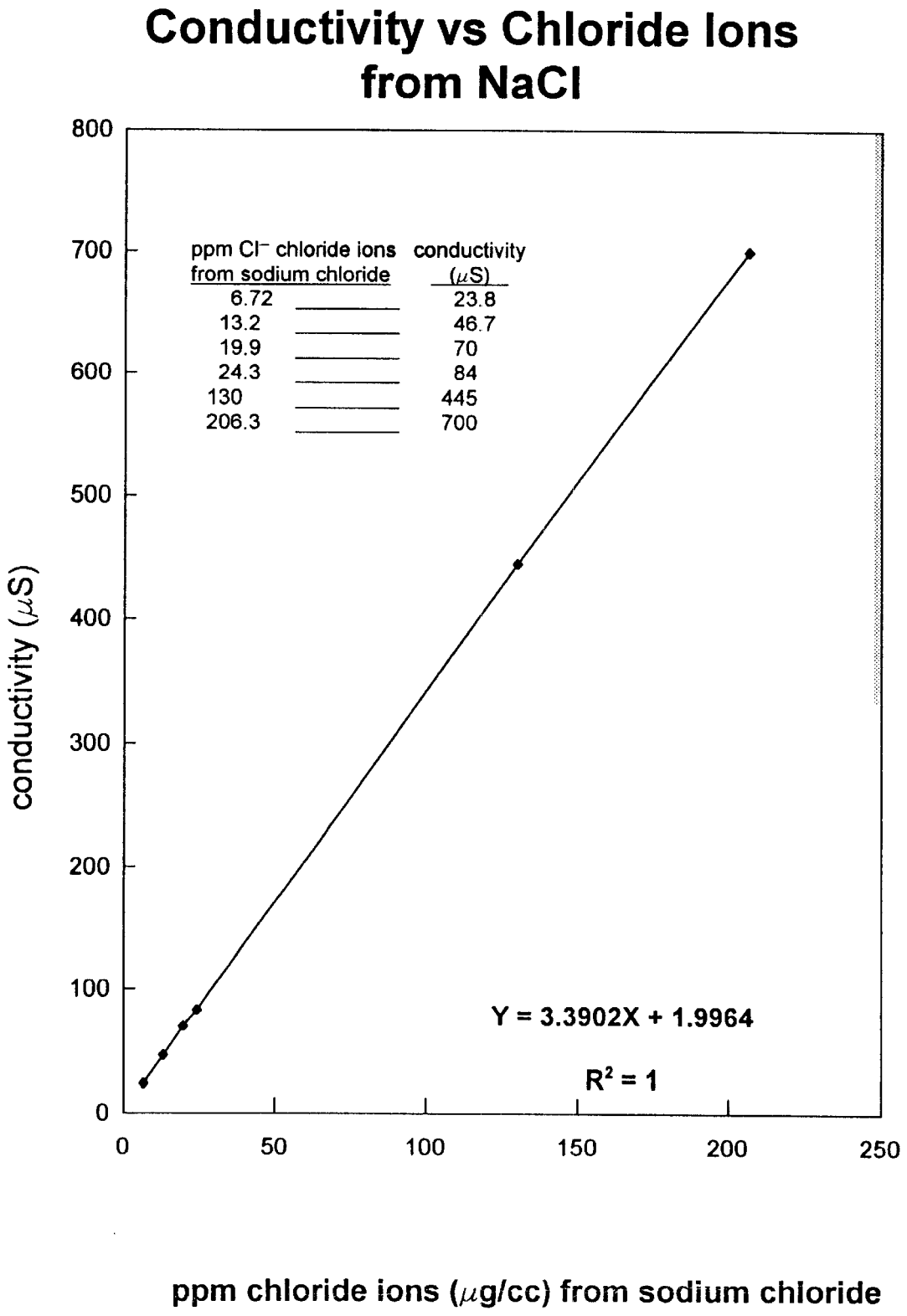

FIG. 10 is a graph of conductivity versus content of chloride ions derived from NaCl expressed as ppm chloride ions from sodium chloride. Reference Numerals in Drawings:

FIG. 1: End view of J-Cell (conductivity cell).

FIG. 2: Side view of J-Cell (conductivity cell).

FIG. 3: View down on top of J-Cell (conductivity cell).

FIG. 4: Cross-section view of J-Cell (conductivity cell).

FIG. 5: Perspective view of J-Cell (conductivity cell).

FIG. 6: Electrical connections for J-Cell during pre-measurement treatment step.

FIG. 7: Electrical connections for J-Cell during measurement of conductivity step.

FIG. 8: Electrical circuitry employed to connect J-Cell from pre-measurement treatment to measurement step.

FIG. 9: (Prior Art) Perspectives of the Bresle Sampler for field analysis of (9A & 9B) chlorides.

FIG. 10: Graph of conductivity vs chloride ions from NaCl.

Reference Numbers in Drawings to Indicate Parts of Drawings

10 Steel bolt passing through hole in anode sheet 15.

11 Steel nut threaded on steel bolt 10 to hold steel bolt 10 and steel sheet 15 in place against the inside of top 12 of Inverted plastic box 16.

12 Top of inverted plastic box 16.

13 Hole in top 12 of inverted plastic box 16 to allow bolt 10 to pass to hold steel sheet 15 in place with installation of steel nut 11.

14 Hole in top 12 of inverted plastic box 16 for addition of water and removal of water solution.

15 Steel sheet anode (positioned against inside of top 12 of inverted plastic box 16).

16 Inverted rigid plastic box.

17 High-strength pressure-sensitive water-resistant adhesive.

18 Steel panel being analyzed (cathode).

19 Hole in steel sheet anode for addition of deionized water 20 and removal of water solution.

FIG. 9B 20 Deionized water.

FIG. 8 21 DPDT switch for changing connections to J-Cell from pre-measurement treatment to measurement step.

FIG. 9A 22 Protective release paper of Bresle Sampler.

FIG. 9A 23 Pressure-sensitive adhesive layer on Bresle Sampler.

FIG. 9A 24 Plastic square surround of Bresle Sampler.

FIG. 9A 25 Cavity of Bresle Sampler.

FIG. 9A 26 Plastic temporary filler for Bresle Sampler Cavity 25.

FIG. 9B 27 Test surface being analyzed with Bresle Sampler.

FIG. 9B 28 Hypodermic needle for water addition and withdrawal from Bresle Sampler.

FIG. 9B 29 Hypodermic syringe to add and withdraw water from Bresle Sampler FIG. 9A,9B 30 Rubber film on outside of Bresle Sampler.

BRIEF SUMMARY OF THE INVENTION

A method has been found to solve the joint problems of removal of chloride Ions from corroded and pitted steel surfaces and measuring the amount of chloride ions present per square centimeter by use of a conductivity cell described in this application.

It has been found in the use of a conductivity cell similar to a limpet (Publ. Ref. 11) in that it is seal to steel surfaces much as a limpet shell seals itself to rock surfaces. A limpet may be defined as "one who clings persistently." The word is used here to describe the clinging characteristic of the J-Cell adhered to a structural steel surface.

This conductivity cell (Johnson or J-Cell) is a non-conductive rigid plastic box which is inverted and sealed to a steel panel by pressure-sensitive water-resistant high-strength adhesive (Duct Seal Adhesive from GB Electrical, Inc., 6101 N. Baker Road, Milwaukee, Wis. 53209). This adhesive in the pure state is non-conductive and free of anions or cations which might affect conductivity measurements. The adhesive is applied to be sufficient to seal the conductivity cell to the to-be-tested steel surface, but not in excess which would undo a defined area of the to-be-tested-steel surface. The box-like J-Cell contains a rigid steel sheet mounted beneath the Inside top of the inverted rigid plastic box. A steel bolt attached to this steel sheet protrudes through a hole in the top of the plastic box and a nut is applied to secure the bolt to the steel sheet. The steel sheet and bolt are attached by an alligator clamp to the anode of a high frequency, low voltage alternating waveform power source. The cathode of the low voltage power source is attached to an abraded bare meal spot on the steel papal being tested, outside of the area covered by the J-Cell.

Previously the rigid plastic box is filled through a second hole in the top of the inverted plastic box with deionized water so that such water fills the inside of the rigid plastic box from the cathode steel panel being tested to the anode beneath the top of the inverted rigid plastic box. The deionized water in this limpet-like conductivity cell (J-Cell) is sealed within the J-Cell by the high-strength pressure-sensitive water-resistant adhesive between the plastic box edges and the steel panel being tested.

In a pre-measurement step, high frequency waveform alternating current is passed between the bottom steel panel cathode and the steel sheet anode under the top and within the rigid plastic box. After about three minutes this current is turned off, and the conductivity between the steel sheet anode and the bottom steel panel cathode is read in $\mu$S by a Sybron meter (the Sybron Conductivity Bridge Meter is available from the Barnstead Company, Division of Sybron Corporation, 225 Rivermoor Street, Boston, Mass. 02132)

connected to the anode and the cathode of the J-cell by a DPDT switch. This conductivity of the water in the J-Cell containing the chloride ions released to the water from the surface of the steel panel being tested is ultimately converted to $\mu$g. of chloride ion per square centimeter of steel surface.

The above brief summary describes the use of the J-Cell to release chloride ions in the pre-measurement step and to measure then within the J-Cell by a Sybron mete reading of the J-Cell's water conductivity.

While this J-Cell is adapted to field analysis of chloride ions on steel surfaces, it has also been found that chloride ions can be washed from steel surfaces with a stream of deionized water after making the metal hose nozzle an anode and the steel sheet surface a cathode and passing a high frequency alternating waveform current between the anode and the cathode. Thus, this recovery of chloride ions from steel surfaces can be adapted to washing of chloride ions from steel surfaces prior to painting.

Further Description Follows Which Provides Details of this Invention.

DESCRIPTION OF INVENTION

Objectives and Advantages

An objective of this application is to provide a method of measuring the quantity of chloride ions on rusted and pitted steel surfaces. This objective is achieved by the release of chloride ions in and beneath the rust on corroded steel surfaces into distilled or deionized water so that the chloride ions present on the steal surface can be determined by the conductivity of the distilled or deionized water present in a conductivity cell sealed against the steel surface. This objective is conveniently accomplished with a conductivity cell which can be used to free the chloride ions into the deionized water in the cell by high frequency alternating current waveform passed between the steel sleet am&e of the conductivity cell and the steal panel cathode beneath the water in the conductivity cell. A simple DPDT switch permits change from the pre-measurement step to a measuring step employing a Sybron meter which measures the conductivity of the water in the J-cell which contains the chloride ions freed into the water by the pre-measurement step. The advantage of this method is that it may be employed in a field instrument adapted to perform both steps in the field and read out total chloride contamination in micrograms of chloride ion per square centimeter of steel surface.

Past means of measurements of chloride ions on corroded steel have been notoriously inaccurate and often provide a value which is much too low. Tests of our process have shown measured recovery of about 85–95% of chloride ions applied to a steel test surface.

Data also is presented showing that the pre-measurement step can be employed to wash chloride ions from a steel surface using a flowing stream of deionized water when the steel surface is the cathode an the meal hose nozzle is the anode for an alternating sine wave current. The advantage of this method is that it washes away chloride ions from chloride ion contaminated corroded and pitted steel surfaces. Chlorides previously could not be so nearly completely removed from such surfaces by water washing or spraying.

The efficient flushing of chloride ions from corroded and pitted steel surfaces using a high frequency alternating sine wave low voltage current is a new means of freeing steel surfaces from chloride ions prior to painting.

Field of Invention

Electrolytic confinement is a term that is used for the condition of blocked or entrapped chloride ions. This blocking (confinement) may generally include such normally accepted causes as (1) the geometry of the pits, (2) inhibitive ions which block by deposition of an insoluble ion onto an electrode, and (3) ions around the pits and their brims which block by electrolytic repulsion (Publ. Ref. 1).

Salts, and in particular chloride ions, severely stimulate corrosion and pitting. Moreover, a high concentration of chloride ions, along with moisture, ozone or oxygen-rich conditions, ordinarily correlates with serious corrosion. Chloride ions characteristically can pit destructively depending on steel composition and the environment. Chloride ions resist retrieval from corroded steel surfaces and, especially, from corroded and pitted surfaces, as found in our work, and which was also reported by Boocock (Publ. Ref. 6). Anions can be confined in pits when the bare Fe walls and bottoms of the pits are anodic due to chloride electrochemical attack upon Fe forming Fe++ or when the steel at the opening of the pit is made cathodic by the battery of a conductivity test instrument. This steel (battery supplied) cathodic effect is not a polarization but is a confinement where the cathodic metal at the rim, or perhaps the brim, of the pit keeps the anions (chlorides) from exiting the pit.

To develop a field conductivity test for chloride anions, one must overcome electrolytic confinement of chloride anions. We have found that a high frequency waveform (such as a sine wave) can overcome the confinement forces and liberate the chloride ions. Our study using the Johnson Cell (J-Cell) showed that high frequency sine waves released more chloride ions than high frequency square waves which in turn released more chloride ions than low voltage (18 volts) direct current.

Chloride deicing salts are a newly widespread, recognized and accepted problem (Publ. Ref, 1) in terms of paint life on steel. No method for liberating and measuring chloride ions from rusted steel has previously been known. (Conductivity meters are currently charged with 400 Hz, often having a square waveform to overcome polarization.) However, our tests prove that the conventional square wave current of a conductivity meter with little or no current flow, as a pre-measurement treatment, does not fulfill the needs for nearly completely liberating chloride ions, as provided in the pre-measurement and the analysis phase of the Johnson Cell. High frequency sine wave with a current flow as a pre-measurement treatment was not known or used previously. We have found such conditions to be necessary and useful to achieve high chloride ion retrieval from steel surfaces. (At least one conductivity meter did employ sine waves, but did not use the sine waves to release chloride ions for measurement following a pre-measurement treatment with high frequency sine waves (Publ. Ref. 12).

Field Instrument Objective

Our objective has been to develop a field analytical instrument for on-site determination of chloride Ion contamination on steel surfaces. Removal of the chloride ions from the bottoms of pits, which are normally anodic, has been a special challenge. High frequency sine wave, pre-measurement treatment has been found to unblock and release a high percentage of the chloride ions for conductivity measurement.

Experimental Data

The following sections identify the apparatus, the procedures and the experiments conducted with the Johnson Cell and the information and conclusions obtained from the experimental results, 1. Apparatus set-up for $Cl^-$ chloride ion testing
2. J-Cell dimensions 3. $Cl^-$ chloride ion testing with the J-Cell—steps to perform
4. The pretreatment (extraction) step
   4.1 Effect of nature of electrical current on $Cl^-$ chloride ion extraction
   4.2 Effect of frequency of AC current on extraction
   4.3 Effect of length of time of pretreatment on $Cl^-$ chloride ion extraction
   4.4 Voltage and amperage levels during pretreatment
   4.5 Frequency generator amplitude settings
   4.6 Stability of readings of $Cl^-$ chloride ion levels by conductance
   4.7 Conductance of solution removed by syringe from J-Cell after pretreatment
   4.8 Measurement of $Cl^-$ chloride ions after sodium chloride contamination of a steel lost panel with a measured amount of sodium chloride
   4.9 Calibration curve employed for measuring $Cl^-$ chloride ions from conductivity measurements based on standard sodium chloride calibration data
5. J-Cell calculations and instrument design
6. Employment of continuous sine wave treatment for continuous washing of $Cl^-$ chloride ions from steel surfaces
7. Johnson Cell use and advantages.

Experimental Details

The experimental details illustrating the procedures employed to collect the data supporting our conclusions are described in the following paragraphs of experiments and their procedures.

1. Apparatus Set-up for $Cl^-$ Chloride Ion Testing 1.1 Johnson Cell: Plexiglas box with open bottom and with dimensions given elsewhere and with bottom edges coated with high strength, water resistant sealant.

1.2 Clamping device (C-clamp or magnetic hold down) to hold the limpet-like J-Cell to the test area.

1.3 File to scratch a clean electrical contact spot at a corner of the rusted steel surface to be tested.

1.4 A clean steel or stainless steel plate with dimensions of 1 inch by 4 inch for the anode.

1.5 A steel bolt and nut holds the steel anode plate against the inside of the top of the plastic J-Cell by passing through a hole in the anode plate matching a hole in the top of the plastic J-Cell, the bolt passing through the top of the J-Cell is held in position by a nut run down to the top of the plastic J-Cell. A wire runs from the alternating current generator to the nut and bolt holding the anode plate against the inside of the plastic top of the J-Cell.

1.6 The steel sample is larger than the open bottom of the Plexiglas body of the J-Cell and thin enough for a pinch clamp to make the electrical connection to the clean spot filed on the steel test sample (cathode).

1.7 A DPDT switch connects the J-Cell to either the high frequency generator or to the Sybron meter for conductivity measurement.

2. Johnson Cell Dimensions

Of the cells that we have constructed, dimensions of the one ($J_5$) that we used herein are given below:

| CELL | $J_5$ | $J_6$ | $J_8$ |
|---|---|---|---|
| Length (cm) | 10.16 | 10.16 | 10.16 |
| Width (cm) | 2.54 | 2.54 | 2.54 |
| Depth (cm) | 3.5 | 0.90 | 0.41 |
| Area (Anode sheet in $cm^2$) | 25.8 | 25.8 | 25.8 |
| Volume (Internal in $cm^3$) | 90.3 | 23.2 | 10.6 |
| Drained Volume in $cm^3$ | 89 | — | — |
| Cell Constant (depth/area) (cm) | 0.136 | 0.0349 | 0.0159 |

Cells $J_6$ and $J_8$ in above table have shorter depths and lower cell conslants. Shallow cells are suited to accurate measurement of low chloride contamination levels.

3. Experimental Details

The experimental details illustrating the procedures employed to perform the pretreatment and measurement are described in the following experimental notes.

J-Cell test steps to perform for pretreatment and measurement:

1. Rinse the cell and the 1"×4" steel or stainless anode plate several times in deionized water having a resistance of 150,000 ohms/cm or more.
2. Place the clean steel plate (anode) inside the cell with the electrical contact post protruding through the plastic top of the J-Cell and with the plate against the inside of the top of the J-Cell.
3. File a spot on the steel sample (cathode) to a somewhat smooth, clean metal surface to be used for electrical contact.
4. Place a sealant on the open-faced edges of the plastic J-Cell.
5. Place the J-Cell on the steel sample panel and clamp in place to maintain water-tight seal.
6. Fill the cell with deionized water with a syringe needle (attached to a syringe) through a hole in the top of the cell.
7. A DPDT switch is connected to allow change from the extraction phase to the analysis phase. The current to be passed (high frequency wave form) is set at the alternating current generator.
8. For a blank reading of the deionized water, allow the full cell to remain undisturbed for approximately three minutes before any current is passed from the alternating current generator.
9. Read the conductance and record. The purpose of this reading is to check the operation of the equipment. The seal should be good. No cell solution should have leaked. The conductance should be close to that of deionized water employed.
10. Apply the high frequency wave form current through the cell, from the wave generator, for six minutes.
11. Throw the switch to connect the Sybron null point conductivity meter to the electrodes of the cell and measure the conductance again.
12. Drain the cell liquid by drawing it through a hole in the top of the J-Cell with a syringe into a clean plastic container as a retain. Mark and label the cup that retains the solution. Make sure no contamination from the skin or from other surfaces comes into contact with the water sample throughout the procedure.
13. In the cup, measure the conductivity by a dip cell test and the volume of recovered cell solution.
14. Data on recovered cell solutions is shown in the following Table 4.1 and is discussed later in 4.7.

4. The Pretreatment (extension) Step

In an effort to devise a method to remove large part of the $Cl^-$ chloride ions present on rusted steel surfaces into deionized water for conductivity measurement, experiments were run on electrical treatment to drive the $Cl^-$ chloride ions from rusted steel into deionized water.

4.1 The following electrical current treatments were tested using conductivity of the water in the J-Cell against a rusted steel test panel to measure $Cl^-$ chloride extraction efficiency.

| Frequency | Wave Nature | Conductivity (μS/cm) | Recovered (μS/cm) Cell Solution |
|---|---|---|---|
| 0 | 18 VDC | 47.0 | 12.9 |
| 0 | 18 VDC | 45.9 | 13.5 |
| 0 | 18 VDC | 46.45 | 13.2 |
| 1,000 | Square | 63.6 | 30.0 |
| 1,000 | Sine | 53.9 | 29.8 |
| 1,000 | Square | 63.6 | 30.0 |
| 1,000 | Sine | 83.9 | 27.77 |
| 18,000 | Square | 62.8 | 28.7 |
| 18,000 | Square | 62.0 | 24.3 |
| 18,000 | Square | 63.8 | 30.3 |
| 18,000 | Sine | 94.4 | 15.8 |
| 18,000 | Sine | 100.2 | 21.9 |
| 18,000 | Sine | 101.6 | 30.5 |
| 18,000 | Square | 62.87 | 27.77 |
| 18,000 | Sine | 98.7 | 24.025 |
| 150,000 | Square | 64.0 | 28.3 |
| 150,000 | Square | 66.3 | 29.0 |
| 150,000 | Sine | 102.2 | 28.0 |
| 150,000 | Sine | 101.7 | 29.2 |
| 150,000 | Square | 65.15 | 28.65 |
| 150,000 | Sine | 101.9 | 28.4 |

4.2 Previous tests indicated effectiveness of AC alternating current sine waves in releasing chloride ions into water. A series of runs were nude to determine the most effective frequency of sine waves for exaction of chloride ions from rusted steel into deionized water above the rusted steel (cathode). The data from these runs is shown below in the table of 4.2 as well as in the table of 4.1

Effectiveness of AC Alternating Current, Sine Waves

| Frequency | Wave Nature | Conductivity (μS/cm) | Recovered (μS/cm) Cell Solution |
|---|---|---|---|
| 1,000 | Sine | 83.9 | 29.8 |
| 1,000 | Sine | 83.9 | 27.77 |
| 18,000 | Sine | 98.7 | 24.03 |
| 18,000 | Sine | 94.4 | 15.8 |
| 18,000 | Sine | 100.2 | 21.8 |
| 18,000 | Sine | 101.6 | 30.5 |
| 150,000 | Sine | 102.2 | 28.0 |
| 150,000 | Sine | 101.7 | 29.2 |
| 150,000 | Sine | 101.9 | 28.4 |

4.3 Effect of length of time of pretreatment (extraction) step on $Cl^-$ chloride ion extraction into deionized water.

An effective alternating current sine wave frequency was tested in triplicate (A, B, C) to determine the possible effect of the time length of treatment on completeness of extraction.

This test was run on a panel contaminated and rusted and dried with a sodium chloride solution on its surface calculated to yield 740 μS conductivity in a $J_5$ cell placed on the dried panel and filled with deionized water (before conductivity tests) was measured repeatedly to observe the effect of length of pretreatment time on completeness of chloride extraction.

Pretreatment Time at 13,000 hertz (sine waves)

| | A | B | C |
|---|---|---|---|
| 3 minutes | 739 μS | 749 μS | 753 μS |
| 6 minutes | 739 μS | 749 μS | 754 μS |
| 9 minutes | 740 μS | 749 μS | 734 μS |
| 12 minutes | 739 μS | 749 μS | 755 μS |
| 30 minutes | 739 μS | — | — |

Time of pretreatment for moderate levels of rust were usually run for 6 minutes. Severe rust levels could require longer pretreatment times.

4.4 Voltage and amperage levels employed during pretreatment

An attempt was made to measure the actual voltage and amperage of the sine waves produced by B&K Audio Generator (Model 3001) when driven by a 9-volt battery (Everready 522BP) in the Audio Generator.

The voltages shown in the following table were measured with a volt-ohm meter (an analog multimeter 9Z47 from GB Instruments GMT-19 was used).

The instrument employed to provide the high frequency current was an Audio Generator Model 3001 made by B&K Precision Test Equipment (Maxtex Inc., 2900T Oregon Court #G3, Torrance, Calif. 90503), this instrument (despite its name) does have electrical leads to supply either square waves or sine waves at chosen dialed frequencies from 1,000 hz to 150,000 hz. The meter was used while set at full amplitude. With this meter, when powered by a fresh 9-volt battery in the meter, we determined the output current and voltage while operating connected to the analog multimeter 9Z47. The measured sine wave and square wave voltages under these conditions with a fresh 9-volt battery are shown in the following table.

| Frequencies (Hertz) | Sine Wave Voltage | Square Wave Voltage |
|---|---|---|
| 150,000 | 0.002 | 0.025 |
| 120,000 | 0.004 | 0.070 |
| 100,000 | 0.009 | 0.129 |
| 80,000 | 0.018 | 0.193 |
| 75,000 | 0.024 | 0.212 |
| 64,000 | 0.045 | 0.252 |
| 50,000 | 0.089 | 0.309 |
| 42,000 | 0.120 | 0.347 |
| 32,000 | 0.170 | 0.410 |
| 28,000 | 0.197 | 0.446 |
| 20,000 | 0.275 | 0.568 |
| 18,000 | 0.304 | 0.633 |
| 15,000 | 0.357 | 0.729 |
| 12,000 | 0.439 | 0.885 |
| 10,000 | 0.514 | 1.036 |
| 8,000 | 0.618 | 1.243 |
| 7,500 | 0.653 | 1.320 |
| 6,400 | 0.739 | 1.497 |
| 5,000 | 0.880 | 1.800 |
| 4,200 | 0.975 | 2.018 |
| 3,200 | 1.123 | 2.364 |
| 2,500 | 1.189 | 2.528 |
| 2,000 | 1.323 | 2.887 |

In spite of the extremely low voltages measured at 150,000 hertz (0.002 volt), the high frequency sine wave was still more effective than higher voltages such as 2.887 volts at 2000 hertz square wave.

4.5 Frequency generator amplitude settings

The BK Model 3001 Audio Generator has an adjustment for amplitude of general waves. In the studies conducted with all alternating current wave forms, this setting was left its maximum amplitude. No studies were made to determine the exact wave amplitudes obtained. However, the wave forms were checked by observations made with an oscilloscope (Textronics, Beaverton, Oreg.) which showed that the wave forms indicated by symbols on the audio generator Model 3001 were match on the oscilloscope screen.

After confirming the wave types indicated on the BK Audio Generator Model 3001, the electrical output of the audio generator was measured with the amplitude set at "full", with the attenuation set at "0". The amperage at the sine wave form was measured with a Micronta Digital Multimeter (Micronta 22-185A Digital Multimeter from Radio Shack). The current was so low that it could only be measured on the 4 ma scale. The results are shown in the following table of milliamperes obtained at various sine wave frequencies.

Amperes from BK Precision Audio Generator

| Measurement | Frequency | Dial | Milliamperes |
|---|---|---|---|
| 1 | 150,000 Hz | 1.5 K × 100 | 1.921 ma |
| 2 | 18,000 Hz | 180 × 100 | 1.949 ma |
| 3 | 1,000 Hz | 1,000 × 1 | 2.008 ma |

Voltage measurements were shown in the table of Section 4,4.

4.6 Stability of readings of $Cl^-$ chloride ion levels by conductance

In order to use conductivity measurements with a field instrument, it is desirable that the reading of conductance is stable for a period of time. A J-Cell test was run to collect data on $Cl^-$ chloride ion removal from a panel contaminated to yield 100 $\mu$S/cm in $J_5$-Cell due to NaCl sodium chloride using a null point (Sybron) conductivity meter with results shown in the following table, using successively longer increments of time for pretreatment with 18,000 Hz sine waves.

| Time (18,000 Hz sine wave) | Conductance (Sybron) | Conductivity (Cell constant 0.136) |
|---|---|---|
| 3 minutes | 739 $\mu$S | 100.5 $\mu$S/cm |
| 6 minutes | 739 $\mu$S | 100.5 $\mu$S/cm |
| 9 minutes | 740 $\mu$S | 100.6 $\mu$S/cm |
| 12 minutes | 739 $\mu$S | 100.5 $\mu$S/cm |
| 30 minutes | 739 $\mu$S | 100.5 $\mu$S/cm |

This table indicates that the $Cl^-$ chloride ions are removed from this steel panel with only a 3-minute treatment using 18,000 Hz sine waves. Increasing lengths or time of treatments up to 30 minutes of length virtually duplicated the results obtained with 3 minutes of sine wave treatment at 18,000 Hz.

Observations on measurements with a (Sybron) null point meter have indicated that conductance results also change very little following several hours of standing after turning off the sine wave pretreatment stop.

4.7 Conductance of solution withdrawn from J-Cell after pretreatment and conductivity measurement.

The solution withdrawn by syringe from the J-Cell after pretreatment and conductivity measurement was measured and found to possess lower conductivity as shown in 4.1 and 4.2. After the clear layer of solution is withdrawn, there remains a brown sludge on the steel test plate. This sludge must contain a significant portion of the $Cl^-$ chloride ions even with much of the $Cl^-$ chloride ion being in the clear supernatant. See data on pages 18 and 19 for recovered solutions (shown in 4.1 and 4.2).

This finding raises the possibility that continuous washing of a steel pie In treatment (extraction) mode would completely flush $Cl^-$ chloride ions from steel surfaces.

4.8 Measurement of $Cl^-$ chloride ions after sodium chloride contamination of a steel test panel with a measured amount of sodium chloride.

To test the effectiveness of J-Cell pretreatment and conductivity measurement on $Cl^-$ chloride ion determination, a steel test panel is coated uniformly with a standard sodium chloride solution to deposit 45.6 $\mu$g of $Cl^-$ chloride ions per square cm. This test panel is placed in a humidity chamber for about 3 days before a $J_5$-Cell is employed to measure the $Cl^-$ chloride ion level by pretreatment with 18,000 hertz sine wave alternating current for 3 minutes. The current is switched off and a Sybron conductivity meter reads the conductance as 47 $\mu$S. This conductance corresponds to 13.2 $\mu$g of $Cl^-$ chloride ions per cc of the $J_5$-Cell using the graph of FIG. 10. With a volume of 90.3 cc, the $\mu$g $Cl^-$ chloride ion in the $J_5$-Cell is 1192 $\mu$g $Cl^-$ chloride ion contained within the $J_5$-Cell. With an area covered of 25.8 $cm^2$, the $Cl^-$ chloride ions on the surface covered by the $J_5$-Cell is 46.2 $\mu$g per $cm^2$ which is 101% of the $Cl^-$ chloride ions uniformly coated on the panel per $cm^2$.

This result would indicate that the experimental errors in measurement are obviously greater than 1%.

4.9 Calibration curve employed for measuring $Cl^-$ chloride ions from conductivity measurements of standard sodium chloride calibration solutions.

Data from Cole Farmer's "Electrochemistry Solutions Catalog", 1999–2000, page 25, on conductivity calibration solutions was plotted as ppm of $Cl^-$ chloride ion ($\mu$g of Cl per cc) against conductivity. The first six data points were plotted representing the $Cl^-$ chloride ion levels of greatest practical interest in painting decisions.

This curve is shown on FIG. 10. The confidence level of the line showing the relationship of conductivity to ppm of $Cl^-$ chloride ion or $\mu$g $Cl^-$ chloride ion per cc of solution was calculated to be $R^2$=1. The line is represented by 3.3902+1.9964.

The practical field interest is on levels of $Cl^-$ chloride ions at or below 5 $\mu g/cm^2$.

5. J-Cell Calculations and Instrument Design

To obtain the calibration curve of FIG. 10 for sodium chloride in ppm versus conductivity, the ppm of sodium chloride is converted to ppm of $Cl^-$ chloride ion by converting the ppm sodium chloride to ppm chloride using the appropriate atomic weights.

$$35.46 \times \text{ppm NaCl} = 0.6066 \times \text{ppm NaCl} = \text{ppm } Cl^- \text{ chloride ion } 58.46$$

which ppm $Cl^-$ chloride ion is equivalent to $\mu$g $Cl^-$ chloride ion per cc. The $\mu$g $Cl^-$ chloride ion per cc is multiplied by the volume of the J-Cell to obtain $\mu$g of $Cl^-$ chloride Ion in the J-cell. This value is divided by the area of the J-Cell to obtain $\mu$g of $Cl^-$ chloride ion per sq cm.

In devising an instrument to read out $\mu g/cm^2$ of $Cl^-$ chloride ions, the conductivity meter scale is modified to convert $\mu$S conductivity to $\mu$g $Cl^-$ chloride ion per $cm^2$ by using the curve shown on FIG. 10 for the commonly found NaCl sodium chloride contamination and the calculations described above to obtain $\mu$g $Cl^-$ chloride ion contamination per $cm^2$ of the panel under test.

The $\mu$g/sq cm defines the condition of the test surface. Values greater than 5 $\mu$g/sq cm require further cleaning and removal of $Cl^-$ chloride ion.

6. Employment of continuous sine wave treatment for continuous washing of $Cl^-$ chloride ions from steel surfaces.

A brief test of continuous washing of $Cl^-$ chloride ions during high frequency sine wave treatment is described below. This test was made to confirm its effect, but no effort was made to optimize washing removal of $Cl^-$ chloride ions from rusted steel High frequency waves liberate chloride ions from electrolytic confinement, but efficiency of liberating chloride ions for conductivity measurement does vary with the type of wave employed, However, even the square wave, the poorest wave we have tested, is still superior to direct current in dislodging trapped and confined chloride ions.

SINE WAVE ENERGIZED WATER SPRAY

To determine the effectiveness of not only a water spray, but a water spray with alternating sine wave current, the nozzle of a water spray was connected to the anode while the steel plate being washed with spray was the cathode.

The data showing the effectiveness of water spray washing steel while the steel is electrified with high frequency sine wave alternating current Is shown below in the following paragraph on enhanced water washing.

SINE WAVE ENHANCED WATER WASHING

Tests were run with alternating sine wave and with DC current. A cleaning test was run on two samples of equally contaminated steel. Chloride ions were removed with a washing unit that consisted of a reservoir, hose and low pressure pump for recycling, drainage lines, and a metal nozzle for anode electrical contact. The equipment was rinsed well with deionized water. The reservoir was filled with 2,700 cc of deionized water. The conductivity of this water was measured. The metal hose nozzle was wired to the anode of the high frequency wave generator set to produce sine waves. The pump and sine wave generator were started with the cathode connected to the steel lest panel. One test was run for three minutes while supplying the test panel wave generator with 18 volts DC from two 9-volt batteries in series.

The other test was made with sine waves at 18,000 Hz from a 9-volt battery driving the audio generator Model 3001.

Calculation on conductivity results show that the sine wave alternating current released more chloride ions than did the DC current, but did not release all the chloride ions into the rinse stream in this initial rudimentary experiment.

7. Johnson Cell use and advantages

The experimental results shown in this section illustrate the ability of the J-Cell to free $Cl^-$ chloride ions in its pretreatment step and to measure them after connecting a conductivity meter to the J-Cell. The effectiveness of high frequency sine waves in releasing $Cl^-$ chloride ions from rusted steel panels has been demonstrated even though very low voltages and amperages are employed. The low voltages and current levels are also effective in continuous treatment washing with water. The low voltages employed in treatment with high frequency sine waves and water washing allow this process to be considered safe for large scale washing of steel to free it of $Cl^-$ chloride ions.

The J-Cell pretreatment and measurement system can also be designed into a field instrument to measure $Cl^-$ chloride ion levels on steel surfaces.

OPERATION OF THE INVENTION

FIELD ELECTROLYTIC PROCEDURE FOR CHLORIDES

Concentration Levis for Onset of Corrosion

Corrosion at the steel/paint interface is caused by even a low 10 $\mu g/cm^2$ concentration of chloride ions (Publ. Ref. 3). The acceptable value for chloride contamination level stands at only 5 $\mu g/cm^2$. A level of 10 $\mu g/cm^2$ and above is recognized as being corrosive. Thus only levels between 0 $\mu g/cm^2$ and 5 $\mu g/cm^2$ are acceptable chloride levels.

DESCRIPTION OF MATERIALS EMPLOYED IN THIS INVENTION

The high-strength water-resistant pressure-sensitive non-conductive adhesive employed to make a water tight seal between the steel panel being tested and the edges of the walls of the inverted box-like rigid plastic limpet-like J-Cell is a compound similar to a commercial product marketed as "Duct Seal" by several suppliers, one among whom is GB Electrical, Inc., Milwaukee, Wis.

Such compounds are selected from high molecular weight polymers containing polymerized polymers and copolymers of esters of acrylic or methacrylic acid, particularly $C_4$ to $C_{10}$ alkyl esters of acrylic acid and $C_8$ to $C_{12}$ alkyl esters of methacrylic acid with the acrylic esters being preferred. Their preparation is exemplified in Patent Re. 24,906.

Plastics which are suitable for fabrication of the J-Cell include water-resistant non-conductive plastics with sufficient rigidity, as exemplified by polymethyl methacrylate polymers. While it is not essential that the plastic be transparent like polymethyl methacrylate, having transparency is advantageous for visual checking on the filling of the cell with deionized water. It is advantageous that the plastic employed possess at least moderate impact resistance and resistance to fracture at 0° C. for field handling.

| | |
|---|---|
| Flexural Modulus | $100 \times 10^3$ p.s.i. |
| Notched Izod | 0.2 ft. - lb./in. |
| Dielectric Strength | 300 (⅛" thick), V./mil. |

The following plastics, thus, would be suitable for fabrication of J-Cells.

ABS
ACETAL
RIGID PVC
HIGH DENSITY POLYETHYLENE
IMPACT POLYSTYRENE
IMPACT POLYPROPYLENE
POLYBUTYLENE TEREPHTHALATE
POLYCARBONATE
POLYETHYLENE TEREPHTHALATE
POLYARYLSULFONE
POLYETHERSULFONE
POLYSULFONE
CELLULOSE ACETATE

This list above should be considered as examples illustrating the invention, but not limiting it to such materials.

UTILITY FOR IONS OTHER THAN CHLORIDES

While this application is directed toward measurement of chloride ions on steel surfaces, this technology is also applicable to other water soluble anions such as sulfates, nitrates and nitrites.

What is claimed is:

1. The process of extracting and removing water soluble anions from a corroded metal surface by placing the corroded metal surface in contact with deionized water while passing a high frequency waveform alternating current between steel anode and the corroded metal surface serving as cathode beneath said deionized water.

2. The process of claim 1 wherein the alternating current is a sine waveform current.

3. The process of claim 1 wherein the alternating current is a saw tooth form current.

4. The process of claim 1 wherein the alternating current is a square waveform current.

5. The process of claim 1 wherein the alternating current possesses a frequency between 200,000 Hz and 1,000 Hz.

6. The process of claim 1 wherein the alternating current possesses a potential of 0.001 to 50 volts.

7. The process of claim 1 as a pretreatment step prior to painting the corroded metal surface.

8. The process of extracting and removing water soluble anions from a corroded metal surface by placing the corroded metal surface in contact with deionized water flowing from a steel nozzle anode while passing a high frequency waveform alternating current between the steel nozzle anode and the corroded metal surface serving as cathode beneath the stream of deionized water.

9. The process of claim 8 wherein the alternating current is a sine waveform current.

10. The process of claim 8 wherein the alternating current is a saw tooth form current.

11. The process of claim 8 wherein the alternating current is a square waveform current.

12. The process of claim 8 wherein the alternating current possesses a frequency between 200,000 Hz and 1,000 Hz.

13. The process of claim 8 wherein the alternating current possesses potential of 0.001 to 50 volts.

14. The process of claim 8 as a pre-treatment step prior to painting the corroded metal surface.

15. The process of extracting and removing chloride ions from a rusted steel surface by placing a stream of deionized water on the rusted steel surface while passing a high frequency waveform alternating current between a metal nozzle anode employed to supply the deionized water stream and said rusted steel surface serving as cathode beneath said deionized water stream.

16. The process of claim 15 wherein the alternating current is a sin waveform current.

17. The process of claim 15 wherein the alternating current is a saw tooth form current.

18. The process of claim 15 wherein the alternating current is a square waveform current.

19. The process of claim 15 wherein the alternating current has a frequency between 200,000 Hz and 1,000 Hz.

20. The process of claim 15 wherein the alternating current has a potential from 0.001 to 50 volts.

21. The process of claim 15 used as a pre-treatment step prior to painting of a steel surface.

* * * * *